US006684845B2

(12) United States Patent
Cho

(10) Patent No.: US 6,684,845 B2
(45) Date of Patent: Feb. 3, 2004

(54) LADDER FRAME OF AN ENGINE

(75) Inventor: Jae-Man Cho, Kyungki-Do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/202,347

(22) Filed: Jul. 23, 2002

(65) Prior Publication Data

US 2003/0015164 A1 Jan. 23, 2003

(30) Foreign Application Priority Data

Jul. 23, 2001 (KR) ..... 2001-44126

(51) Int. Cl.[7] ..... F02F 7/00
(52) U.S. Cl. ..... 123/195 H
(58) Field of Search ..... 123/195 H, 195 C, 123/195 R, 196 A, 196 R; 184/6.5, 106

(56) References Cited

U.S. PATENT DOCUMENTS 4,237,847 A * 12/1980 Baugh et al. ..... 123/195 R
4,615,314 A 10/1986 Baugh
5,150,675 A 9/1992 Murata
5,357,922 A 10/1994 Han
5,901,680 A * 5/1999 Ozeki ..... 123/195 R

FOREIGN PATENT DOCUMENTS

JP 1995-098711 4/1995

* cited by examiner

*Primary Examiner*—Tony M. Argenbright
*Assistant Examiner*—Katrina B. Harris
(74) *Attorney, Agent, or Firm*—Pennie & Edmonds LLP

(57) ABSTRACT

An engine ladder frame with minimized noise and vibrations, improved stability of the oil filter, and reduced air in the oil flowing from the cylinder head to the oil pan. Inside an elongate rectangular outer block, three partitioning walls are formed equidistantly, so as to form four crank chambers. The crank chambers respectively have bottom faces which are not perforated or open but are completely closed. On the side parts of the bottom faces, there are respectively formed oil flow faces which gradually become deeper in the direction of the revolutions of the crankshaft. Among the oil flow faces, those of the first, second and third crank chambers have oil drain holes respectively at their ends. Thus the bottoms of the crank chambers are closed so as to close the space between the cylinder block and the oil pan, resulting in the reduction of the noise and vibrations.

7 Claims, 4 Drawing Sheets

LADDER FRAME OF AN ENGINE

FIELD OF THE INVENTION

The present invention relates to a ladder frame of an engine, and more particularly, to a ladder frame with partition walls defining separate crank chambers.

BACKGROUND OF THE INVENTION

Generally, an automobile engine includes a cylinder block having cylinders for reciprocally receiving pistons, a cylinder head for installing cam shafts to actuate suction and exhaustion valves, which are installed in the upper portion of the cylinder block, and an oil pan installed in the lower portion of the cylinder block and containing an amount of oil for lubricating the sliding portions of the engine.

The cylinder block is classified in accordance with the length of the skirt into either a long stroke type cylinder block or a short/semi stroke type cylinder block. In the long stroke type cylinder block, the oil pan is directly coupled to the bottom. On the other hand, in the short/semi stroke type cylinder block, a bed plate (the case where the main bearing cap is formed integrally) or a ladder frame (the case where the main bearing cap is formed as a separate member) is interposed between the oil pan and the cylinder block.

In the case where the ladder frame is involved, the cylinder block and the ladder frame form the crank chambers. The oil pan, with an amount of oil therein, is coupled to the bottom of the ladder frame, thereby forming the overall structure of the engine. Accordingly, the ladder frame together with the cylinder block performs a role in ensuring the strength and rigidity of the power train system.

In an engine using a ladder frame, the ladder frame is disposed between the cylinder block and the oil pan. Therefore, the ladder frame is formed such that the respective crank chambers are bottomless, so that the oil drops freely from the cylinder block into the oil pan. Thus, there are no bottoms in the crank chambers, and therefore, the ladder frame is installed by fastening only the edges and the bulkheads thereof to those of the cylinder block respectively.

As a result, during the operation of the engine, the ladder frame is exposed to the vibrations that are generated by the combustion pressure and by the driving of the power train system. Furthermore, vibration is directly transmitted to the oil pan via the ladder frame. Therefore, the conventional engine with a ladder frame is at a disadvantage with respect to noise and vibration.

Further, an oil filter is installed on the ladder frame to filter out foreign materials from the engine oil. In order to install this oil filter, conventionally, a separate installation member (such as a bracket for providing a seat for the oil filter) is used, resulting in the increase in number of the components and process steps.

SUMMARY OF THE INVENTION

The present invention provides a ladder frame of an engine, in which the ladder frame between the cylinder block and the oil pan is provided with a bottom wall, thereby dampening the noise and vibrations during operation of the engine. Preferred embodiments of the present invention provide a ladder frame in which installability of the oil filter or an oil cooler is improved. Also oil dropping from the cylinder head drains into the oil pan in a more stable form, thereby reducing air in the engine oil.

In a ladder frame according to an embodiment of the present invention, a plurality of crank chambers are formed within an outer block by forming a plurality of separating walls. A plurality of recessed bearing installation parts are respectively formed on the separating walls and on the walls of the outer block. A plurality of bottom faces are formed on the bottoms of the crank chambers, respectively. A plurality of inclined oil flow faces are also formed on the bottom faces, respectively, with the oil flow faces being inclined downward toward drain holes in the direction of revolution of the crankshaft.

In an alternative preferred embodiment, an outer block has a bottom, two end walls and two side walls. At least three partition walls in the block divide the cavity into at least four crank chambers. Recess bearing installation seats are formed in each of the end walls and partition walls. The bottom also defines inclined oil flow faces in each crank chamber with a low point at one side. At least one crank chamber bottom defines an oil drain hole at the low point. At least one partition wall defines an oil flow passage communicating between the oil drain hole and an adjacent crank chamber. In a further preferred embodiment, at least three crank chambers bottoms define oil drain holes and the partition wall associated with a fourth crank chamber defines an oil flow passages.

BRIEF DESCRIPTION OF THE DRAWINGS

The features and advantages of the present invention will be more apparent from the detailed description of the present invention with reference to the attached drawings in which.

DETAILED DESCRIPTION OF THE INVENTION

As shown in drawings, a ladder frame according to an embodiment of the present invention is formed as an essentially elongate rectangular outer block 1 in the case of a 4-cylinder engine. Inside the rectangular outer block 1, three partitioning walls 2*a*, 2*b* and 2*c* are formed equidistantly apart, so as to form four crank chambers 3*a*, 3*b*, 3*c* and 3*d*.

On the partitioning walls 2*a*, 2*b* and 2*c*, and on front and rear walls 1*a* and 1*b* of the outer block 1, there are formed elongate upward-openings, i.e., main bearing installation parts 4*a*, 4*b*, 4*c*, 4*d* and 4*e*, for installing main bearings to support a crank shaft. The outer end of the main bearing installation part 4*e* of the outer wall 1*b* is to be connected to the input shaft of the transmission, and is arcuate or almost arcuate so as to dampen noise and vibrations.

The crank chambers 3*a*, 3*b*, 3*c* and 3*d* of the outer block 1, respectively, have bottom walls 5*a*, 5*b*, 5*c* and 5*d* which are not perforated or open, but are completely closed. On the inside surface of the bottom walls 5*a*, 5*b*, 5*c* and 5*d*, there are respectively formed inclined oil flow faces 6*a*, 6*b*, 6*c* and 6*d* which become gradually deeper in the revolution direction of the crank shaft. Oil flow faces 6*a*, 6*b* and 6*c*, those of the first, second and third crank chambers 3*a*, 3*b* and 3*c* have oil drain holes 7*a*, 7*b* and 7*c*, respectively, at their ends opening through the block. However, oil flow face 6*d*, that of the fourth crank chamber 3*d* is not covered by an oil pan (not illustrated), which is installed under the ladder frame and therefore does not have its own drain hole that opens directly through the block.

Figure 1:
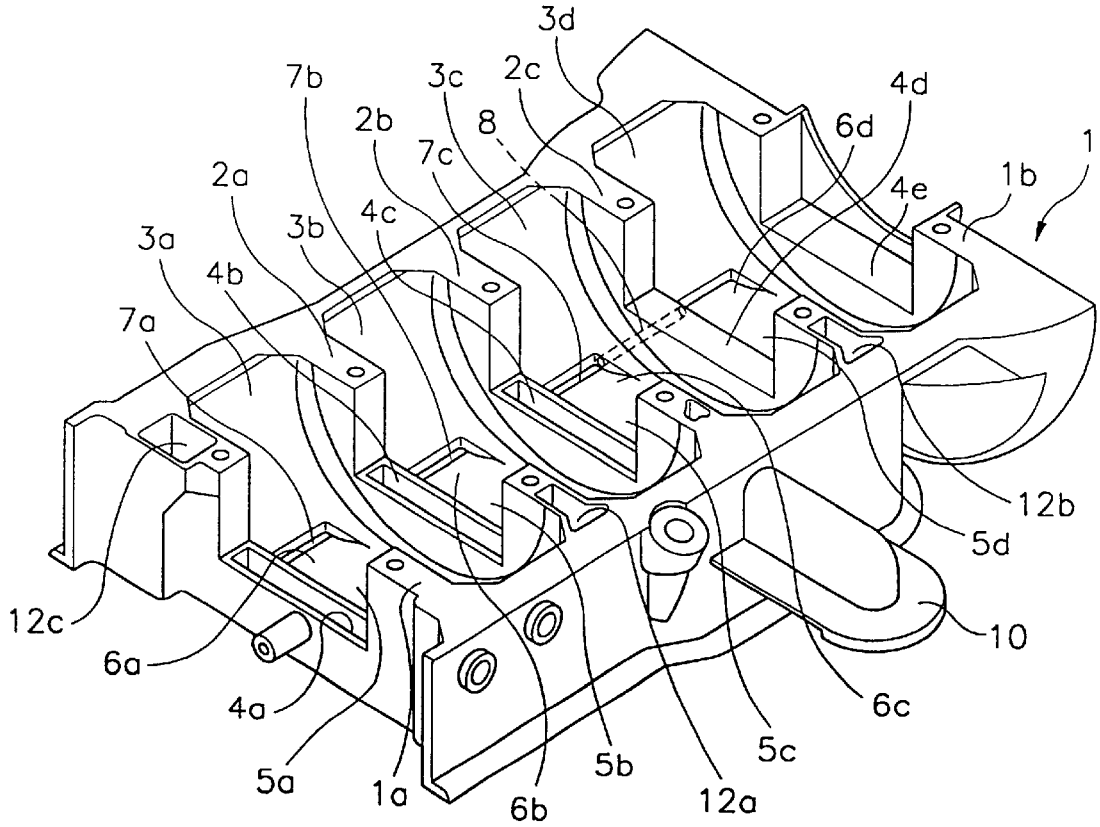
FIG. 1 is a perspective view of the ladder frame of an engine according to the present invention.
Figure 2:
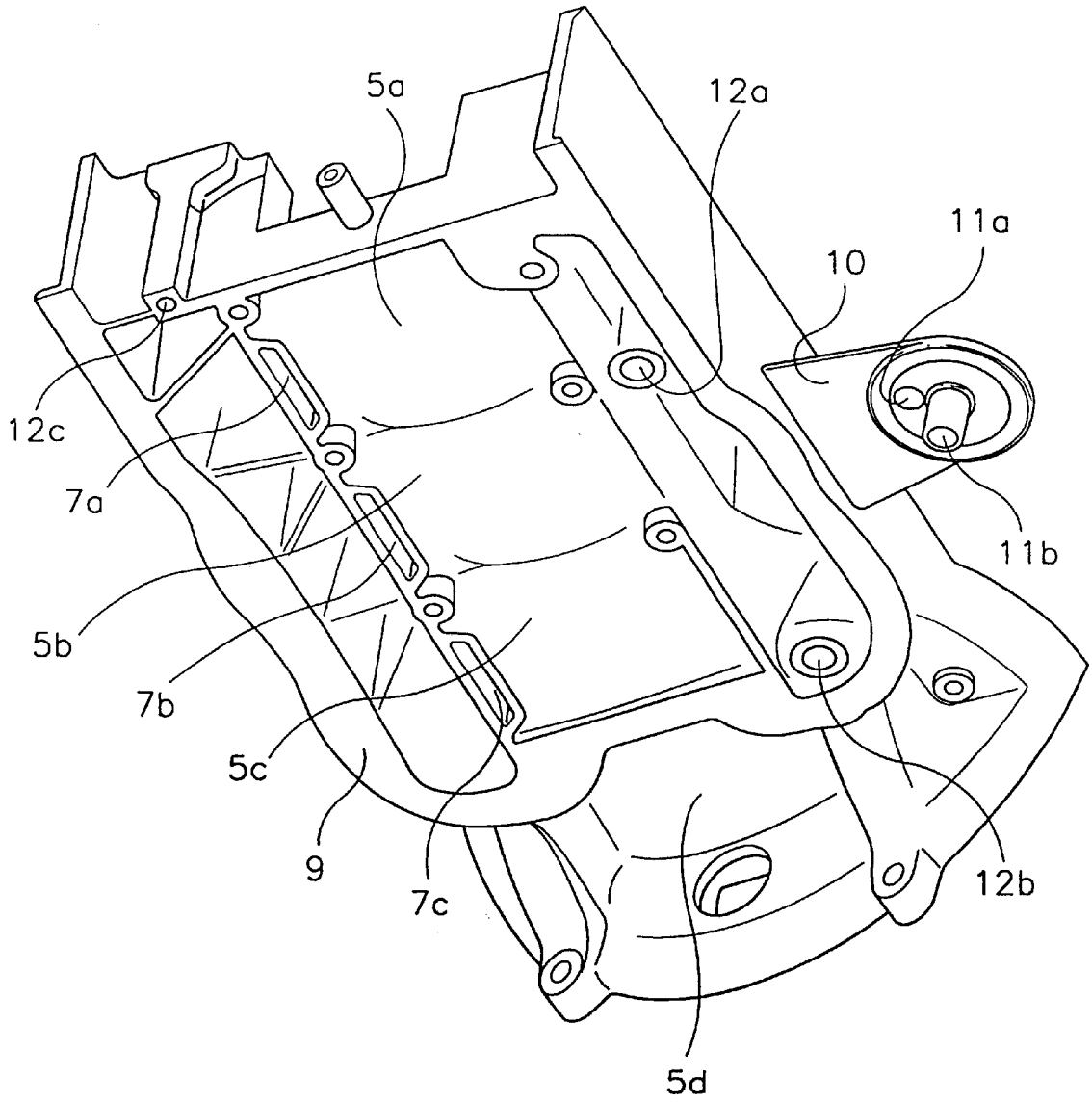
FIG. 2 is a perspective view of the bottom of the ladder frame shown in FIG. 1.

As illustrated by FIG. 2, the oil pan, installed on an oil pan installation face 9, covers only the first, second and third crank chambers 3*a*, 3*b* and 3*c*. Accordingly, the oil drain hole is not formed through the oil flow face of the fourth crank chamber. Instead, the oil flow face communicates at its low point with a connecting passage 8 (FIG. 1) formed through the partitioning wall 2*c* which separates the third and fourth crank chambers 3*c* and 3*d* from each other.

Further, at a side center of the outer block 1, there is formed an oil filter installation part 10 which projects outward. Preferably, the oil filter installation part is formed large enough to take into account the case where the oil filter is replaced with a larger filter, or where an oil cooler is additionally installed later.

Figure 3:
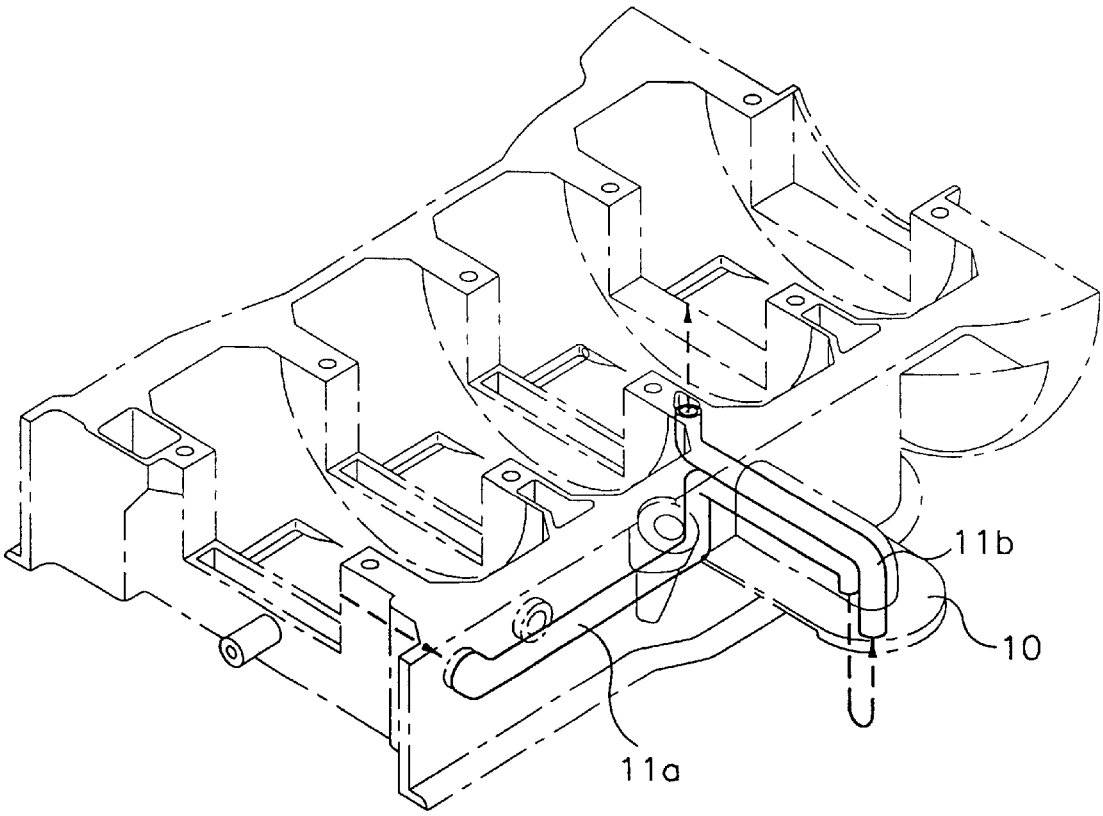
FIG. 3 illustrates the oil passages formed inside the ladder frame shown in FIG. 1.

As shown in FIG. 3, oil passages 11*a* and 11*b* are formed through the oil filter installation part 10 and the outer block 1, the oil passages leading to the oil filter. Oil passage 11*a* is a pre-filtering passage for leading the oil into the oil filter, while oil passage 11*b* is a post-filtering passage for draining the filtered oil.

Inside the partitioning wall 2*a* between the first and second crank chambers 3*a* and 3*b*, and inside the partitioning wall 2*c* between the third and fourth crank chambers 3*c* and 3*d*, there are vertically formed oil drain passages 12*a* and 12*b*, respectively, for receiving oil from the cylinder head. Outer wall 1*a* of the first crank chamber 3*a* has an oil drain passage 12*c* for ventilating the engine.

Major parts of the present invention such as the bottom faces 5*a*, 5*b*, 5*c* and 5*d*, the oil flow faces 6*a*, 6*b*, 6*c* and 6*d*, the oil drain holes 7*a*, 7*b* and 7*c*, the connecting passage 8, the oil filter installation part 10, the oil passages 11*a* and 11*b* to and from the oil filter, the cylinder head oil passages 12*a* and 12*b*, and the ventilation oil passage 12*c* are all preferably fabricated simultaneously by die or mold cores. Thus, separate machining or drilling works are minimized.

The sizes of the drain holes 7*a*, 7*b* and 7*c* which are respectively formed through the bottom walls 5*a*, 5*b* and 5*c* of the crank chambers 3*a*, 3*b* and 3*c* are also respectively subjected to an optimum tuning, so that pumping loss can be minimized.

Figure 4:
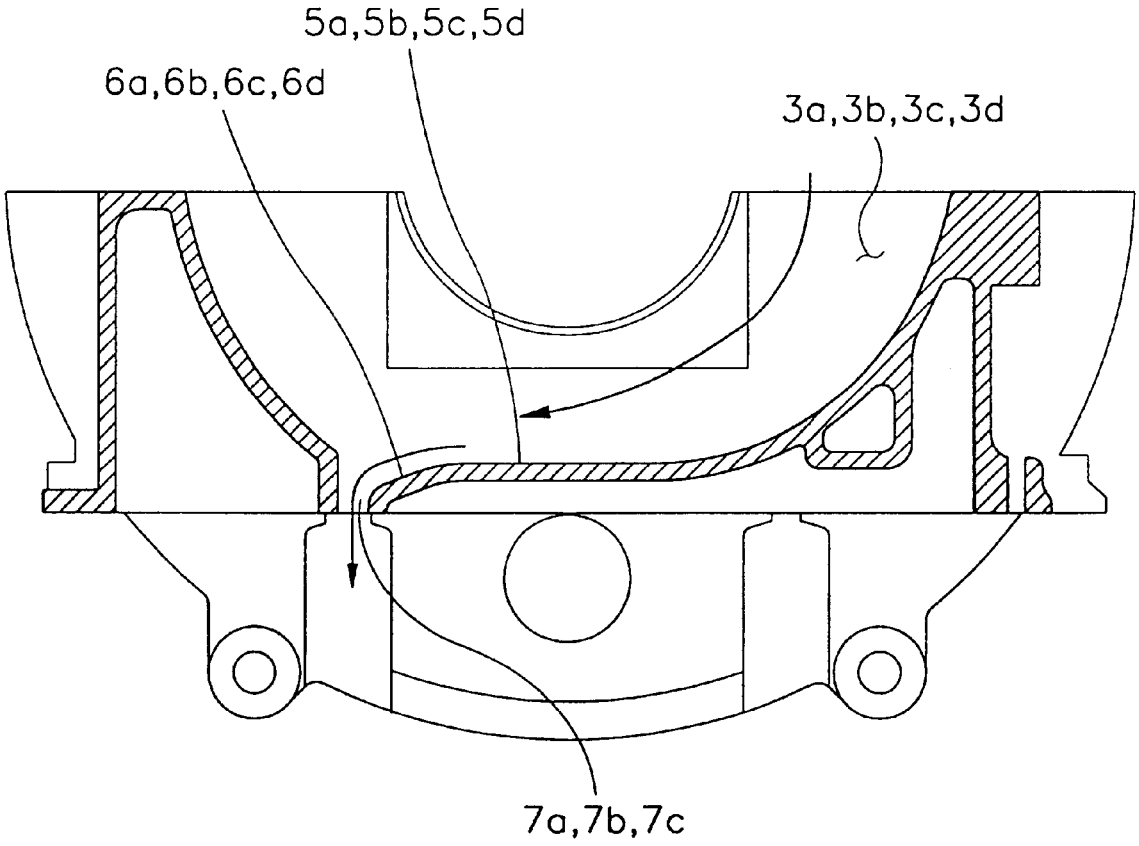
FIG. 4 is a lateral sectional view of the ladder frame shown in FIG. 1.

FIG. 4 illustrates the procedure for draining the oil in the respective crank chambers 3*a*, 3*b*, 3*c* and 3*d*. When the engine operates, the oil which drops from the respective cylinders is collected at the bottom walls 5*a*, 5*b*, 5*c* and 5*d* of the respective crank chambers 3*a*, 3*b*, 3*c* and 3*d*. This oil moves along the inclined oil flow faces 6*a*, 6*b*, 6*c* and 6*d* of the bottom walls 5*a*, 5*b*, 5*c* and 5*d*. Then the oil passes through the oil drain holes 7*a*, 7*b* and 7*c* to be collected into the oil pan which is installed under the ladder frame. The oil of the bottom of the fourth crank chamber 3*d* passes through the connecting passage 8, which is connected to the third crank chamber 3*c*. Thus, the oil of the fourth crank chamber 3*d* moves to the bottom of the third crank chamber 3*c*, and then, the oil is drained through the drain hole 7*c* into the oil pan.

During the operation of the engine, air flow occurs within the crank chambers 3*a*, 3*b*, 3*c* and 3*d* in the same direction as the revolution of the crank shaft, owing to the revolution of the crankshaft. The air flow pushes the oil at the bottom walls 5*a*, 5*b*, 5*c* and 5*d* toward the ends of the oil flow faces 6*a*, 6*b*, 6*c* and 6*d*, so that oil drains smoothly through the oil drain holes 7*a*, 7*b* and 7*c* and the connecting passage 8.

Vibrations which are generated by the combustion pressures and the driving of the power train system are dampened by bottom walls 5*a*, 5*b*, 5*c* and 5*d*. As a result, vibration is not directly transmitted to the oil pan which is installed under the ladder frame. Thus, the present invention reduces noise and vibration and improves the rigidity of the engine.

In the present invention, the oil filter may be directly installed onto the oil filter installation part 10. Hence, the number of components and process steps are reduced. Further, the oil filter installation part 10 sufficiently projects from the outside surface of the outer block 1 of the ladder frame. Therefore, when later replacing the oil filter with a larger filter, or when an oil cooler is additionally installed, a sufficient area is ensured, so that the two components do not interfere with each other. Accordingly, the layout need not be altered.

Additionally, in the present invention, oil drops to the oil pan after passing through the drain passages 12*a*, 12*b* and 12*c*. Therefore, not only is the drop height reduced, but also the air content in the oil is also decreased. Consequently, the degradation of the performance of the oil due to the air content can be prevented.

According to the present invention as described above, the bottoms of the crank chambers are closed, so that the noise and vibrations can be dampened. Further, when installing the oil filter, the number of components and process steps are reduced. Further, when replacing the oil filter with a larger one, or when adding an oil cooler later, the installing operation becomes simplified. Also, the exclusive oil draining passages are formed, so that the air content in the oil can be minimized, thereby preventing the performance degradation of the engine oil.

What is claimed is:

1. A ladder frame of an engine, comprising:

a plurality of crank chambers formed within an outer block by forming a plurality of separating walls;

a plurality of recessed bearing installation parts respectively formed on the separating walls and walls of the outer block;

a plurality of bottom walls formed in said crank chambers respectively; and a plurality of inclined oil flow faces formed on the bottom walls respectively, the oil flow faces being inclined downward in a revolution direction of a crankshaft.

2. The ladder frame as claimed in claim 1, wherein at least one of the oil flow faces have oil drain holes, the oil drain holes being disposed to communicate with an oil pan.

3. The ladder frame as claimed in claim 1, wherein at least one of the separating walls for forming the crank chambers have connecting passages to allow adjacent oil flow faces to communicate with each other.

4. The ladder frame as claimed in claim 1, further comprising an oil filter installation part projecting to a predetermined length from a side of the outer block, the oil filter installation part having oil passages for incoming and outgoing of the oil to and from the oil filter.

5. The ladder frame as claimed in claim 1, wherein at least one of the separating walls for forming the crank chambers have oil drain passages for oil coming from a cylinder head; and the outer block has an oil drain passage for the incoming oil during engine ventilation.

6. A ladder frame of an engine, comprising:

an outer block with a bottom, two end walls and two side walls;

at least three partition walls in the block dividing said cavity into at least four chambers; and recessed bearing installation seats formed in each of said end walls and partition walls;

wherein said bottom defines inclined oil flow faces in each crank chamber with a low point at one side, at least one crank chamber bottom defining an oil drain hole at said low point, and at least one partition wall defining an oil flow passage communicating between said oil drain hole and an adjacent crank chamber.

7. The ladder frame of claim 6, wherein:

at least three crank chamber bottoms define an oil drain hole; and the partition wall associated with a fourth crank chamber defines the oil flow passage.

* * * * *